US008736642B2

(12) United States Patent
Ichikura et al.

(10) Patent No.: US 8,736,642 B2
(45) Date of Patent: May 27, 2014

(54) OUTPUT CIRCUIT FOR REDUCING OFFSET FOR USE IN SOURCE DRIVER ADAPTED TO DRIVE LIQUID CRYSTAL DEVICE

(75) Inventors: Hiroyoshi Ichikura, Ibaraki (JP); Koji Yamazaki, Ibaraki (JP)

(73) Assignee: Lapis Semiconductor Co., Ltd., Yokohama (JP)

( * ) Notice: Subject to any disclaimer, the term of this patent is extended or adjusted under 35 U.S.C. 154(b) by 253 days.

(21) Appl. No.: 13/418,719

(22) Filed: Mar. 13, 2012

(65) Prior Publication Data

US 2012/0249607 A1 Oct. 4, 2012

(30) Foreign Application Priority Data

Mar. 31, 2011 (JP) ..... 2011-078010

(51) Int. Cl.
*G09G 3/36* (2006.01)

(52) U.S. Cl.
USPC ..... 345/690; 345/87

(58) Field of Classification Search
None
See application file for complete search history.

(56) References Cited

U.S. PATENT DOCUMENTS

2009/0278868 A1* 11/2009 Nakahira et al. ..... 345/690
2011/0187757 A1* 8/2011 Yang et al. ..... 345/690

FOREIGN PATENT DOCUMENTS

JP 11-044872 A 2/1999
JP 2001-067047 A 3/2001

* cited by examiner

*Primary Examiner* — Joseph Haley
(74) *Attorney, Agent, or Firm* — Rabin & Berdo, P.C.

(57) ABSTRACT

An offset-reducing output circuit of a source driver adapted to drive a liquid crystal device. The output circuit includes an operational amplifier having a non-inverting input to receive a reference voltage. The output circuit also includes input and output capacitors. One terminal of the input capacitor and one terminal of the output capacitor are connected to a node extending to an inverting input of the operational amplifier in at least a normal output operation mode. The output circuit also includes a switching circuit to short both terminals of the input capacitor and both terminals of the output capacitor in a reset operation so that the reference voltage is applied to the terminals of the input and output capacitors respectively. The switching device applies a gray scale voltage to an opposite terminal of the input capacitor in a normal operation mode.

9 Claims, 7 Drawing Sheets

OUTPUT CIRCUIT FOR REDUCING OFFSET FOR USE IN SOURCE DRIVER ADAPTED TO DRIVE LIQUID CRYSTAL DEVICE

FIELD OF THE INVENTION

The present invention relates to an offset-reducing output circuit of a source driver adapted to drive a liquid crystal device.

DESCRIPTION OF THE RELATED ART

A source driver to drive a liquid crystal panel is equipped with a function of canceling an offset component of a driving voltage issued from an output circuit including an operational amplifier. Such source drivers are, for example, disclosed in Japanese Patent Application Publication (Kokai) No. 11-044872 and Japanese Patent Application Publication (Kokai) No. 2001-67047. FIG. 1 of the accompanying drawings is a circuit diagram showing the structure of an output circuit for reducing an offset of a source driver in Japanese Patent Application Publication No. 2001-67047. The offset-reducing output circuit 5 is a capacitor-coupled operational amplifier, and includes an output amplifier 1, an input capacitor Cin, an output capacitor Cout, switch devices SW1 to SW6, and a resistor R1. A reference voltage VOP and a voltage VDAC are supplied to the offset-reducing output circuit 5 as input voltages. The voltage VDAC is a voltage (gray-scale voltage) obtained by converting digital data representing the gray scale of each pixel supplied to a source driver into an analog voltage by a D/A (digital/analog) converter (not shown) provided in the source driver. An application terminal of the reference voltage VOP is connected to a non-inverting input terminal of the output amplifier (operational amplifier) 1. An inverting input terminal of the output amplifier 1 is connected to one terminal of the input capacitor Cin and also connected to one terminal of the output capacitor Cout. The switch device SW1 is connected between an application terminal of the voltage VDAC and an opposite terminal of the input capacitor Cin. The switch device SW2 is connected between the application terminal of the reference voltage VOP and the opposite terminal of the input capacitor Cin. The switch device SW3 is connected between the non-inverting input terminal and the inverting input terminal of the output amplifier 1. The switch device SW4 is connected between the inverting input terminal of the output amplifier 1 and an output terminal OUT of the output amplifier 1. The switch device SW5 is connected between an opposite terminal of the output capacitor Cout and the output terminal OUT of the output amplifier 1. The switch device SW6 is connected between the opposite terminal of the output capacitor Cout and the application terminal of the reference voltage VOP. One terminal of the resistor R1 is connected to the output terminal OUT of the output amplifier 1, so that an output voltage of the output amplifier 1 is issued, as a driving voltage, from a terminal PAD through the resistor R1.

The offset-reducing output circuit 5 of FIG. 1 has a reset operation and a normal output operation. The reset operation is triggered upon receiving an external reset signal in synchronization with a vertical synchronization signal of an image signal. The voltage VDAC is generated in synchronization with a horizontal synchronization signal during the normal output operation.

Referring now to FIG. 2 of the accompanying drawings, the reset operation of the output circuit 5 will be described. In the reset operation, the switch devices SW1 and SW5 are turned off, and the switch devices SW2, SW3, SW4, and SW6 are turned on. As a result, voltages at all connection points (nodes), expressed as black dots in FIG. 2, become equal to the reference voltage VOP. This is the reset operation. In other words, the reference voltage VOP is applied to the opposite terminal of the input capacitor Cin through the switch device SW2 while being applied to an opposite terminal of the output capacitor Cout through the switch device SW6. Since the inverting input terminal and the non-inverting input terminal of the output amplifier 1 are shorted with each other by the switch device SW3, an offset voltage ΔV is generated at the output terminal of the output amplifier 1. The offset voltage ΔV is supplied to a node FB through the switch device SW4. Accordingly, the offset voltage ΔV is charged or accumulated in the input capacitor Cin and the output capacitor Cout. In this state, the operation of the offset reduction output circuit 5 is stabilized.

Referring now to FIG. 3, the normal output operation of the output circuit 5 will be described. When the operation mode changes to the normal output operation from the reset operation, the switch devices SW1 and SW5 are turned on, and the switch devices SW2, SW3, SW4, and SW6 are turned off as shown in FIG. 3. The node FB of the inverting input terminal comes into a floating state, and the output amplifier 1 is operated in such a manner that the voltage of the node FB stays at the reference voltage VOP. In other words, charges flow in the input capacitor Cin corresponding to the voltage difference between the reference voltage VOP and the voltage VDAC, and charges flow in the output capacitor Cout corresponding to the voltage difference between the output voltage of the output amplifier 1 and the reference voltage VOP. Therefore, an output voltage is generated from the output amplifier 1 with the offset voltage ΔV being cancelled. Since a voltage corresponding to the voltage VDAC is applied to the inverting input terminal through the input capacitor Cin, a voltage corresponding to a differential voltage between the reference voltage VOP and a voltage of the inverting input terminal is generated. In the normal output operation, the output voltage of the output amplifier 1 is supplied, as a driving voltage, to pixels of a liquid crystal display panel during a writing period in response to a writing signal in every one horizontal writing period.

SUMMARY OF THE INVENTION

Referring now to FIG. 4, the operation of the offset reduction output circuit 5 shown in FIG. 1 will be further discussed. As described earlier, the output circuit 5 generates the reset and writing signals. In the reset operation, the voltage at the node FB of the inverting input terminal of the output amplifier 1 approximates the reference voltage VOP (including offset voltage ΔV) in response to the reset signal. If the normal output operation is performed after the reset operation, the voltage of the node FB gradually decreases from the reference voltage VOP. This phenomenon occurs due to the leakage current flowing to a base element (substrate) of the switch device SW4 including a field-effect transistor (FET), and/or the leakage current between a source and a drain of the switch device SW4. Accordingly, it is difficult to maintain the reference voltage VOP at the node FB of the inverting input terminal of the output amplifier 1 for a long time, and therefore an offset voltage in the output voltage of the output amplifier 1 increases to degrade display quality of the liquid crystal display panel.

An object of the present invention is to provide an offset reduction output circuit used for a source driver of a liquid crystal device, capable of preventing display quality degradation by properly reducing an offset voltage of an output amplifier.

According to one aspect of the present invention, there is provided an offset reduction output circuit of a source driver for receiving a gray scale voltage corresponding to gray scales represented by digital data and for generating a driving voltage to a liquid display panel. The offset reduction output circuit includes an operational amplifier having a non-inverting input terminal to receive a reference voltage. The offset reduction output circuit also a first input capacitor and a first output capacitor. One terminal of the first input capacitor and one terminal of the first output capacitor are connected to a first node connected to an inverting input terminal of the operational amplifier in at least a normal output operation. The offset reduction output circuit also includes a first switching circuit to short both terminals of the first input capacitor and short both terminals of the first output capacitor in a reset operation so that the reference voltage is applied to the terminals of the first input and output capacitors. The first switching circuit is also adapted to apply the gray scale voltage to an opposite terminal of the first input capacitor and connect an opposite terminal of the first output capacitor to an output terminal of the operational amplifier in the normal output operation after the reset operation. The first switching circuit has first and second switch devices connected with each other in series at a predetermined connection point. The first and second switch devices are connected between the first node and the output terminal of the operational amplifier. The first and second switch devices are turned on in the reset operation, and turned off in the normal output operation. The reference voltage is applied to the predetermined connection point of the first and second switch devices in the normal output operation.

Since the reference voltage is applied to the in-series connection point (predetermined connection point) of the first and second switch devices in the normal output operation of the offset reduction output circuit, the voltage at the in-series connection point is fixed to the reference voltage. Therefore, a voltage between the two terminals (for example, voltage between the source and the drain) of the first switch device provided on the first node side becomes equal to the reference voltage. Thus, the leakage current between the both terminals of the first switch device can be reduced. In addition, the current leaking from the output terminal of the operational amplifier to the first node through the both terminals of the first switch device can be reduced. Consequently, the offset voltage of the operational amplifier can be properly reduced, so that the degradation of the display quality can be prevented.

These and other objects, aspects and advantages of the present invention will become apparent to those skilled in the art from the following detailed description when read and understood in conjunction with the appended claims and drawings.

DETAILED DESCRIPTION OF THE INVENTION

Figure 1:
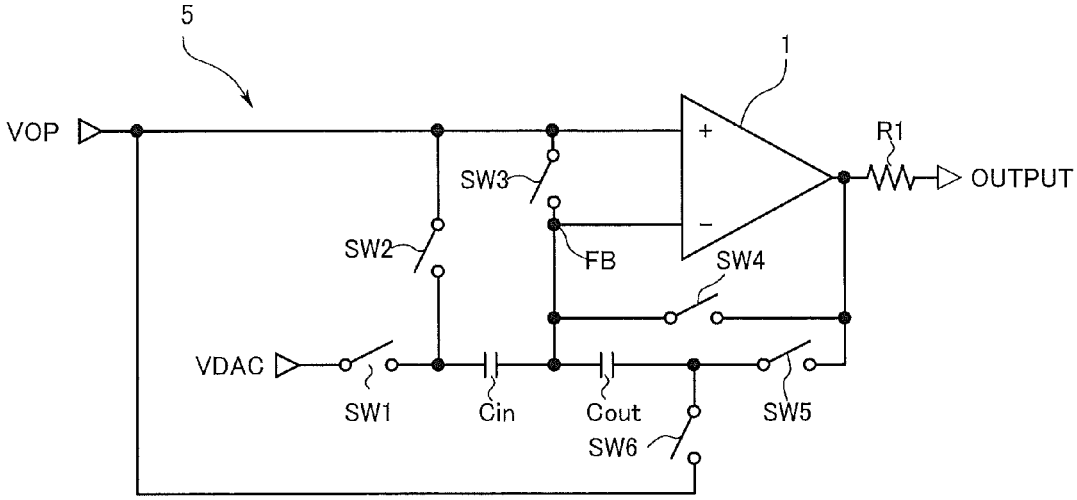
FIG.1 PRIOR ART
FIG. 1 shows a circuit diagram of an offset reduction output circuit according to the related art.
Figure 2:
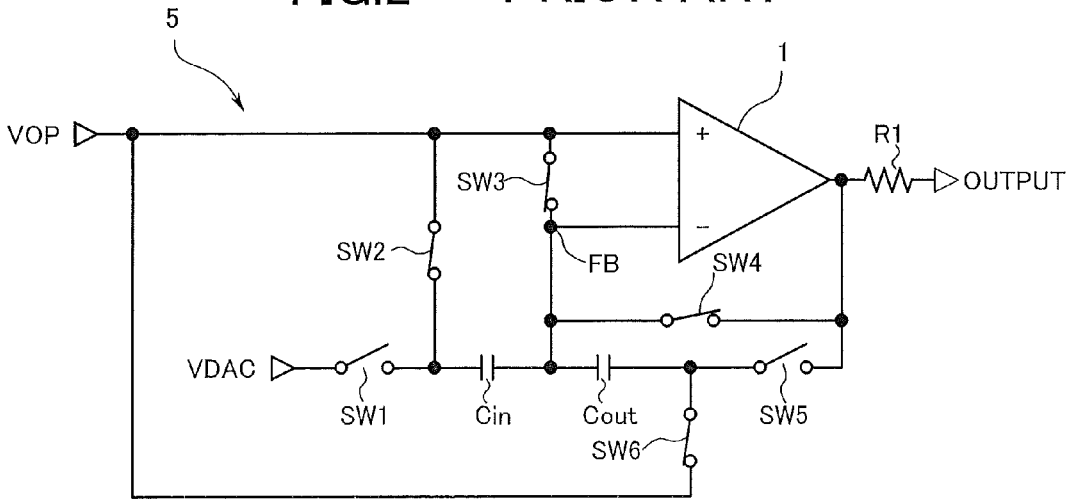
FIG.2 PRIOR ART
FIG. 2 is a circuit diagram showing on/off states of switch devices in the output circuit shown in FIG. 1 during a reset operation.
Figure 3:
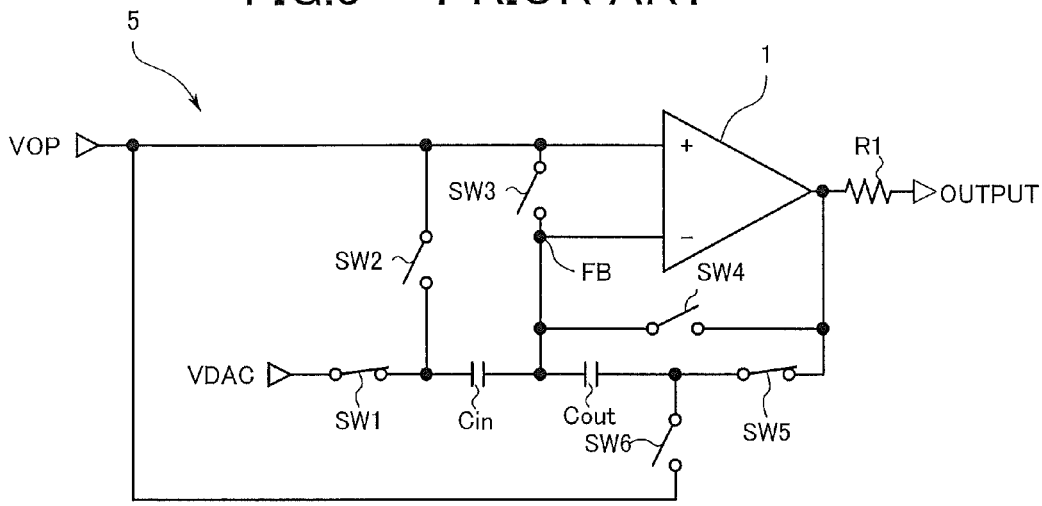
FIG.3 PRIOR ART
FIG. 3 is a circuit diagram showing on/off states of the switch devices in the output circuit of FIG. 1 during a normal output operation.
Figure 4:
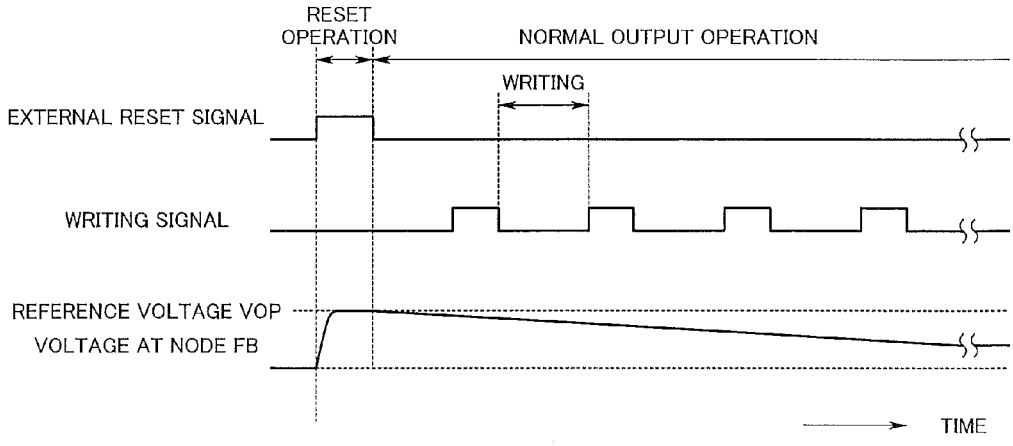
FIG.4 PRIOR ART
FIG. 4 depicts a timing chart among an external reset signal, a writing signal, and the voltage variation at a particular node in the output circuit of FIG. 1.

Exemplary embodiments of the present invention will be described with reference to FIG. 5 to FIG. 12 of the accompanying drawings. Like reference numerals and symbols are used to designate like elements and items in different drawings.

Figure 5:
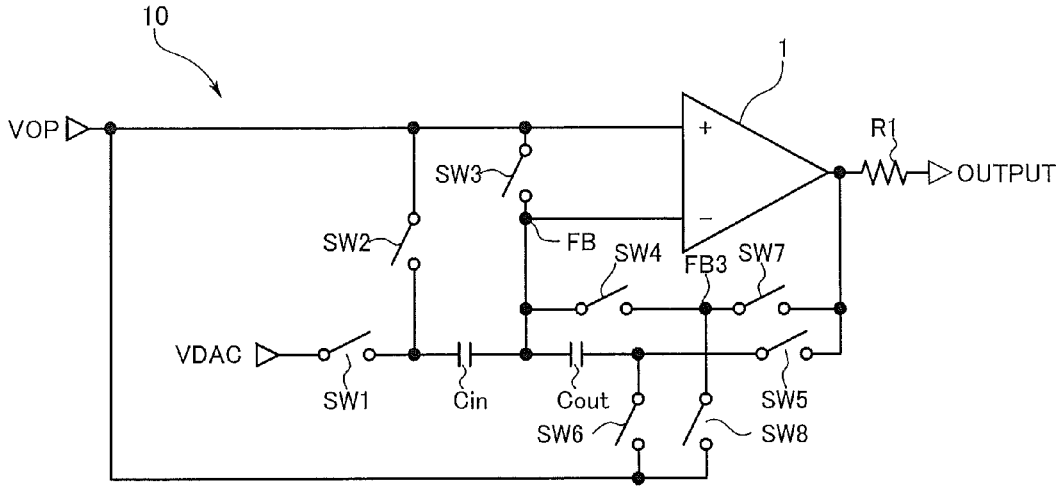
FIG. 5 illustrates a circuit diagram of an offset reduction output circuit according to a first embodiment of the present invention.

Referring to FIG. 5, the structure of an offset reduction output circuit 10 according to a first embodiment of the present invention will be described. The offset reduction output circuit 10 includes switch devices SW7 and SW8 in addition to the structure of the offset reduction output circuit 5 shown in FIG. 1. The switch device SW7 is connected to a switch device SW4 in series. One terminal of the switch device SW4 is connected to an inverting input terminal of an output amplifier 1, and an opposite terminal of the switch device SW7 is connected to an output terminal OUT of the output amplifier 1. The switch device SW8 is connected between a connection point (node) FB3, which is provided between the switch device SW4 and the switch device SW7, and an application terminal of a reference voltage VOP. Since other components of the output circuit 10 are similar to those shown in FIG. 1, the details thereof will not be described here.

The switch devices SW1 to SW8 constitute a switching circuit. Each switch device has a P-channel FET, and a channel between a source and a drain is turned on or turned off according to a control signal supplied to a gate of the P-channel FET. A power supply voltage VDD is applied to a base element (substrate or back gate) of the FET. The switch device SW4 corresponds to a first switch device, the switch device SW7 corresponds to a second switch, and the switch device SW8 corresponds to a third switch device.

In this embodiment, the power supply voltage VDD is 18V, the reference voltage VOP is 3V, a ground voltage VSS is 0V, and the voltage VDAC is in the range from 0V to 18V. It should be noted, however, that the present invention is not limited to these numerals.

Similar to the offset reduction output circuit 5 shown in FIG. 1, the offset reduction output circuit 10 having the above-described structure performs a reset operation and a normal output operation. The reset operation is performed upon receiving an external reset signal in synchronization with a vertical synchronization signal of an image signal.

Figure 6:
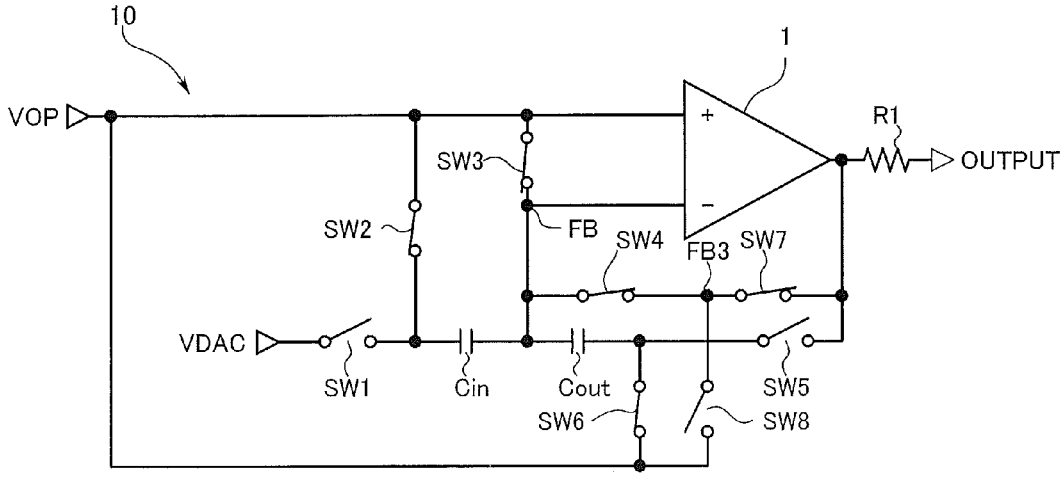
FIG. 6 illustrates a circuit diagram showing on/off states of switch devices in a reset operation of the output circuit shown in FIG. 5.

Referring to FIG. 6, the reset operation of the output circuit 10 will be described. In the reset operation, the switch devices SW1, SW5, and SW8 are turned off, and the switch devices SW2, SW3, SW4, SW6, and SW7 are turned on. Therefore, the reference voltage VOP is applied to an opposite terminal of an input capacitor Cin through the switch device SW2 while being applied to an opposite terminal of an output capacitor Cout through the switch device SW6. Since an inverting input terminal of the output amplifier 1 and a non-inverting input terminal of the output amplifier 1 are shorted with each other by the switch device SW3, an offset voltage ΔV is generated at the output terminal of the output amplifier 1. The offset voltage ΔV is supplied to a node FB through the switch devices SW7 and SW4. As a result, the offset voltage ΔV is charged in the input capacitor Cin and the output capacitor Cout. In this state, the operation of the offset reduction output circuit 10 is stabilized.

Figure 7:
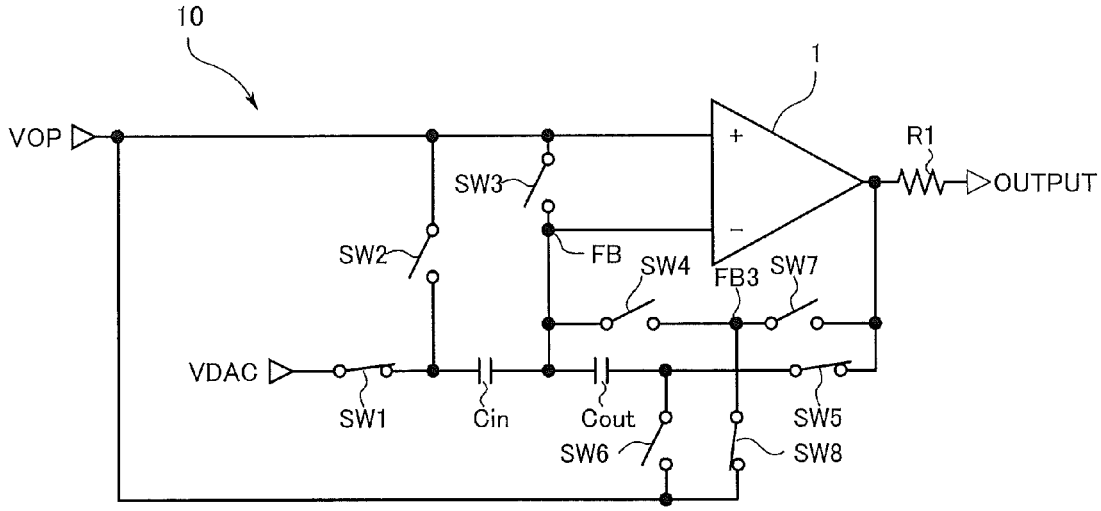
FIG. 7 is a circuit diagram showing on/off states of switch devices in a normal output operation of the output circuit shown in FIG. 5.

Referring to FIG. 7, the normal output operation will be described. When a normal output operation is performed after the reset operation, the switch devices SW1, SW5, and SW8 are turned on, and the switch devices SW2, SW3, SW4, SW6, and SW7 are turned off as shown in FIG. 7. The node FB of the inverting input terminal comes into a floating state, the output amplifier 1 is operated in such a manner that the voltage of the node FB is kept to the reference voltage VOP. In other words, charges flow in the input capacitor Cin corresponding to the differential voltage between the reference voltage VOP and the voltage VDAC, and charges flow in the output capacitor Cout corresponding to the differential voltage between the output voltage of the output amplifier 1 and the reference voltage VOP. Therefore, the output voltage is generated from the output amplifier 1 with the offset voltage ΔV being canceled. In the normal output operation, the output voltage of the output amplifier 1 is supplied, as a driving voltage, to pixels of a liquid crystal display panel by those switching elements (not shown) which are turned on during a writing period in response to a writing signal in every one horizontal writing period.

Since the reference voltage VOP is applied to the node FB3 of the switch devices SW4 and SW7 through the switch device SW8, the voltage of the node FB3 is held to the reference voltage VOP. Therefore, the voltage between both terminals of the switch device SW4, that is, the voltage between the source and the drain of the switch device SW4 is equal to the reference voltage VOP, and a current leaking between the source and the drain of the switch device SW4 is reduced. Also a current leaking from the output terminal OUT of the output amplifier 1 to the node FB through the channel between the source and the drain of the switch device SW4 is reduced.

Figure 8:
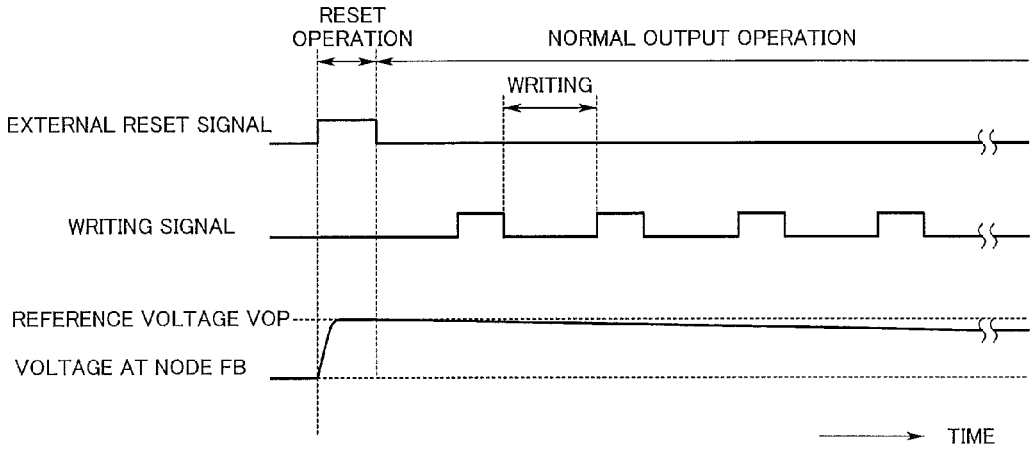
FIG. 8 is a timing chart among an external reset signal, a writing signal, and the voltage variation at a particular node in the output circuit of FIG. 5.

Therefore, as shown in FIG. 8, the voltage at the node FB of the inverting input terminal of the output amplifier 1 is equal to the reference voltage VOP in response to the reset signal in the reset operation. Even if the normal output operation is performed after the reset operation, the voltage at the node FB is approximately maintained at the reference voltage VOP for a long time. In other words, since the leakage current can be reduced as described above, the reference voltage VOP at the node FB hardly drops. Accordingly, the offset voltage of the output amplifier 1 is cancelled in an appropriate matter, and the degradation of the display quality is prevented.

Figure 9:
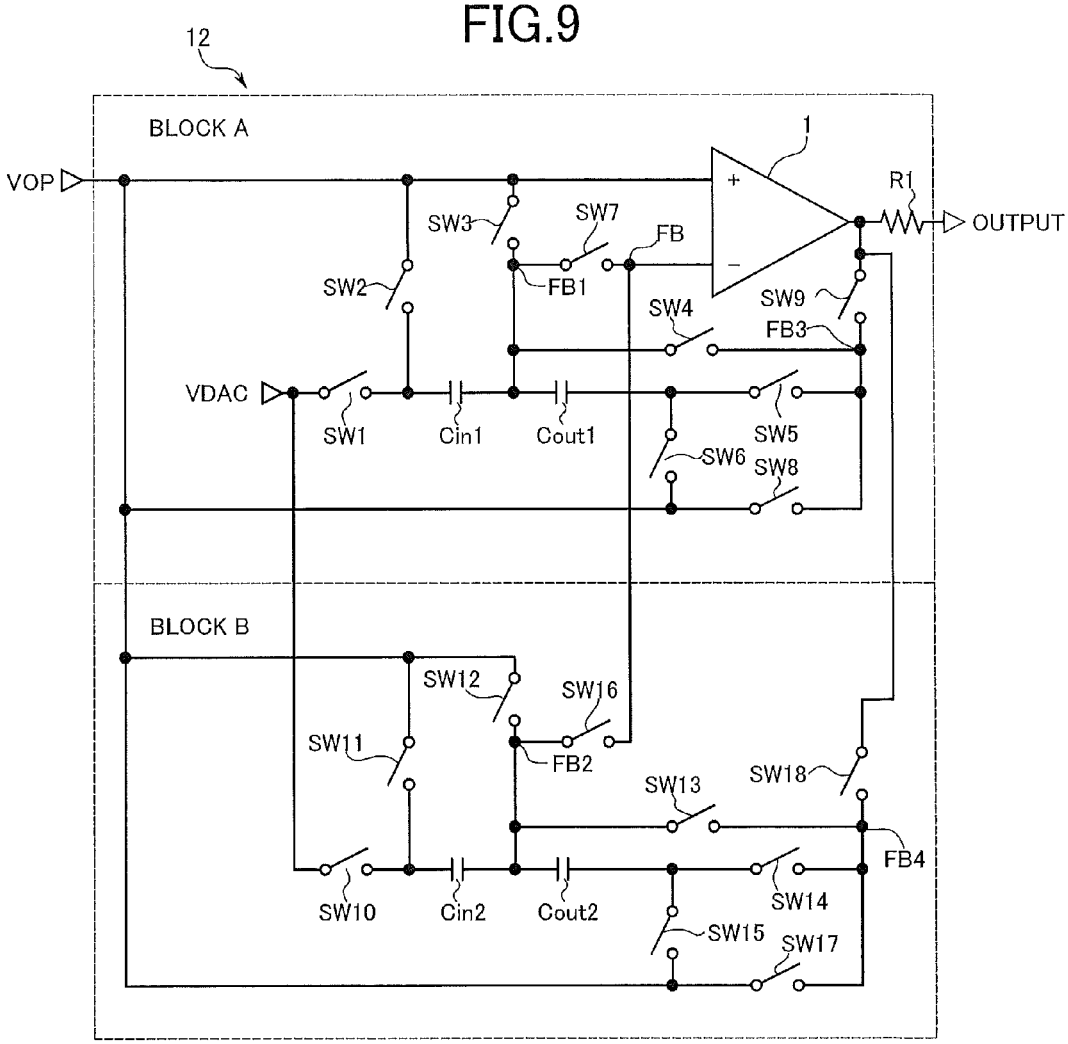
FIG. 9 is a circuit diagram of an offset reduction output circuit according to a second embodiment of the present invention.

FIG. 9 illustrates the structure of the offset reduction output circuit 12 according to a second embodiment of the present invention. Similar reference numerals and symbols are used in the first and second embodiments to designate similar elements and items. The offset reduction output circuit 12 includes a block A and a block B. The block A includes switch devices SW3, and SW7 to SW9 in addition to the structure of the offset reduction output circuit 5 shown in FIG. 1. In the second embodiment, the input capacitor is designated by Cin1, not Cin, and may be referred to as a first input capacitor, and the output capacitor is designated by Cout1, not Cout, and may be referred to as a first output capacitor. The application terminal of the reference voltage VOP is connected to a non-inverting input terminal of the output amplifier 1, and the switch device SW1 is connected between the application terminal of the voltage VDAC and an opposite terminal of the input Capacitor Cin1. The switch device SW2 is connected between the application terminal of the reference voltage VOP and the opposite terminal of the input capacitor Cin1. The switch device SW3 is connected between the application terminal of the reference voltage VOP and one terminal of the input capacitor Cin1, that is, a node FB1. The node FB1 is connected to one terminal of the output capacitor Cout1. The switch device SW4 is connected to the switch device SW9 in series. One terminal of the switch device SW4 is connected to the node FB1, and the opposite terminal of the switch device SW9 is connected to the output terminal OUT of the output amplifier 1. The switch device SW5 is connected between an opposite terminal of the output capacitor Cout1 and a node which is provided between the switch device SW4 and the switch device SW9. The switch device SW6 is connected between the opposite terminal of the output capacitor Cout1 and the application terminal of the reference voltage VOP. The switch device SW7 is connected between the node FB of the inverting input terminal of the output amplifier 1 and the node FB1. The switch device S8 is connected between the application terminal of the reference voltage VOP and the node between the switch device SW4 and the switch device SW9.

The block B includes switch devices SW10 to SW18, an input capacitor Cin2 (second input capacitor), and an output capacitor Cout2 (second output capacitor). Other components of the block B are the same as those of the block A except for the output amplifier 1. Regarding the relation between components of the blocks A and B, the input capacitor Cin2 corresponds to the input capacitor Cin1, and the output capacitor Cout2 corresponds to the output capacitor Cout1. The switch device SW10 corresponds to the switch device SW1, the switch device SW11 corresponds to the switch device SW2, and the switch device SW12 corresponds to the switch device SW3. Since other components of the block B correspond to other components of block A in order of reference numerals, the description thereof will be omitted. The opposite terminal of the input capacitor Cin2 is connected to a node FB2.

The block A may be referred to as a first block, and the block B may be referred to as a second block. The switch device SW13 may be referred to as the fourth switch device, the switch device SW18 may be referred to as the fifth switch device, and the switch device SW17 may be referred to as the sixth switch device.

Figure 10:
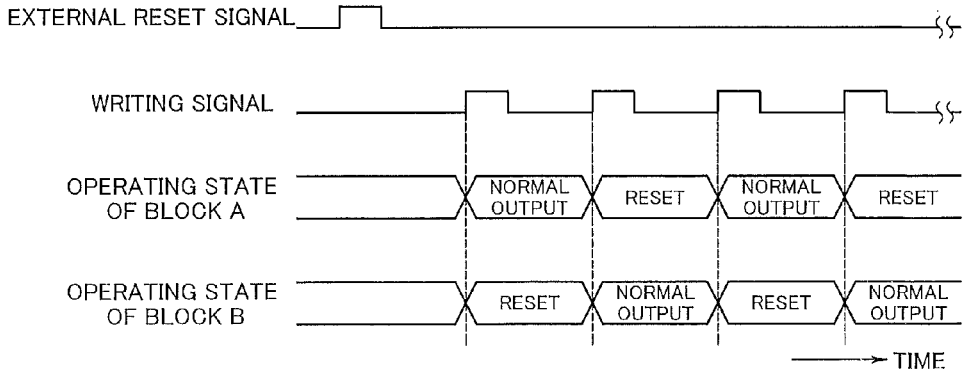
FIG. 10 is a timing diagram showing the operations of two blocks in the output circuit shown in FIG. 9.

Referring to FIG. 10, the block A and the block B of the output circuit 12 alternately repeat the normal output operation and the reset operation in response to the writing signal in every one horizontal writing period. When the block A performs the normal output operation, the block B performs the reset operation. When the block A performs the reset operation, the block B performs the normal output operation.

For example, at the beginning of each frame, the block A may perform the reset operation in response to the external reset signal and then performs the normal output operation in response to an initial writing signal. The block B performs the reset operation in response to the initial writing signal. Thereafter, the blocks A and B perform the reset operation and the normal output operation as shown in FIG. 10.

Figure 11:
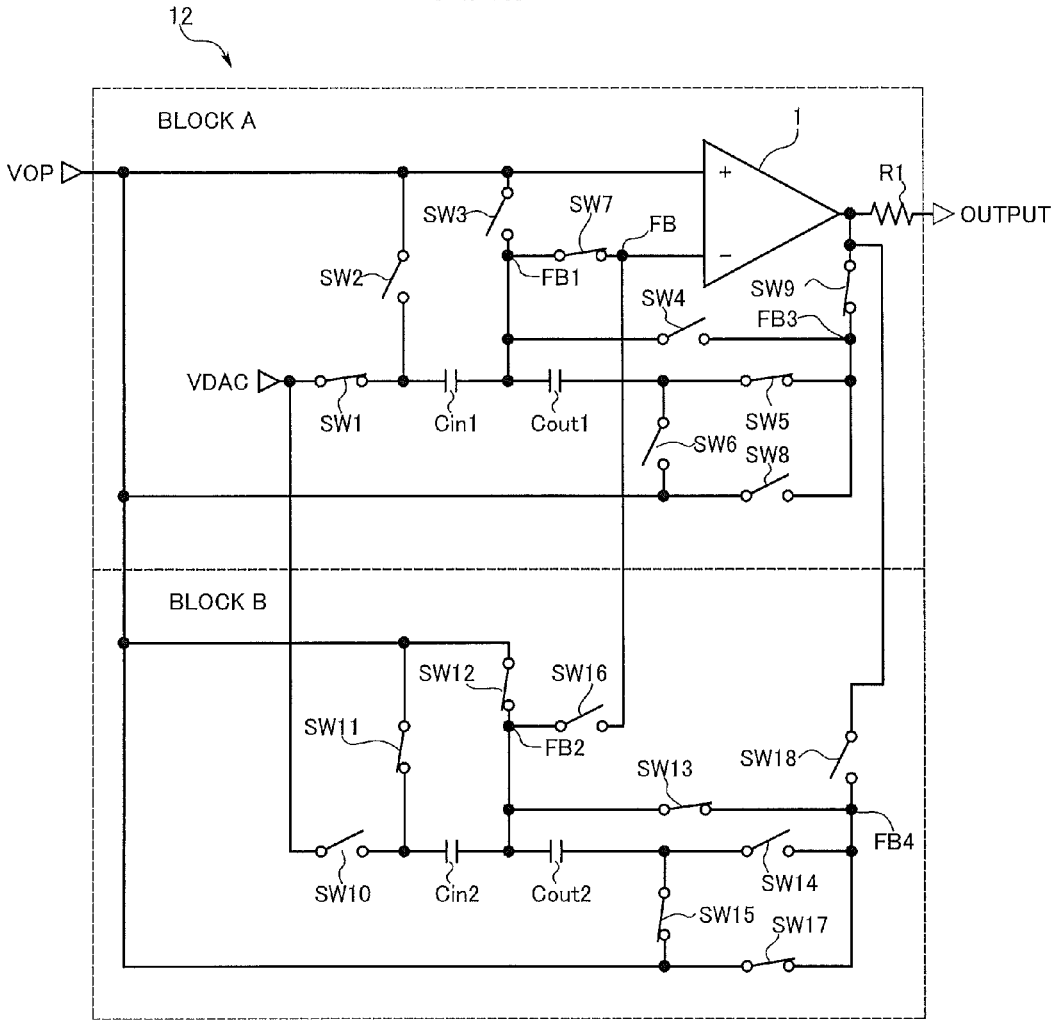
FIG. 11 is a circuit diagram showing on/off states of switch devices when one block is in a reset condition and the other block is in a normal output mode in the circuit of FIG. 9.

When the block A is in the normal output mode and the block B is in the reset mode, the switch devices SW1, SW5, SW7, and SW9 in the block A are turned on, and the switch devices SW2 to SW4, SW6, and SW8 in the block A are turned off as shown in FIG. 11. In the block B, the switch devices SW10, SW14, SW16, and SW18 are turned off, and the switch devices SW11 to SW13, SW15, and SW17 are turned on.

Figure 12:
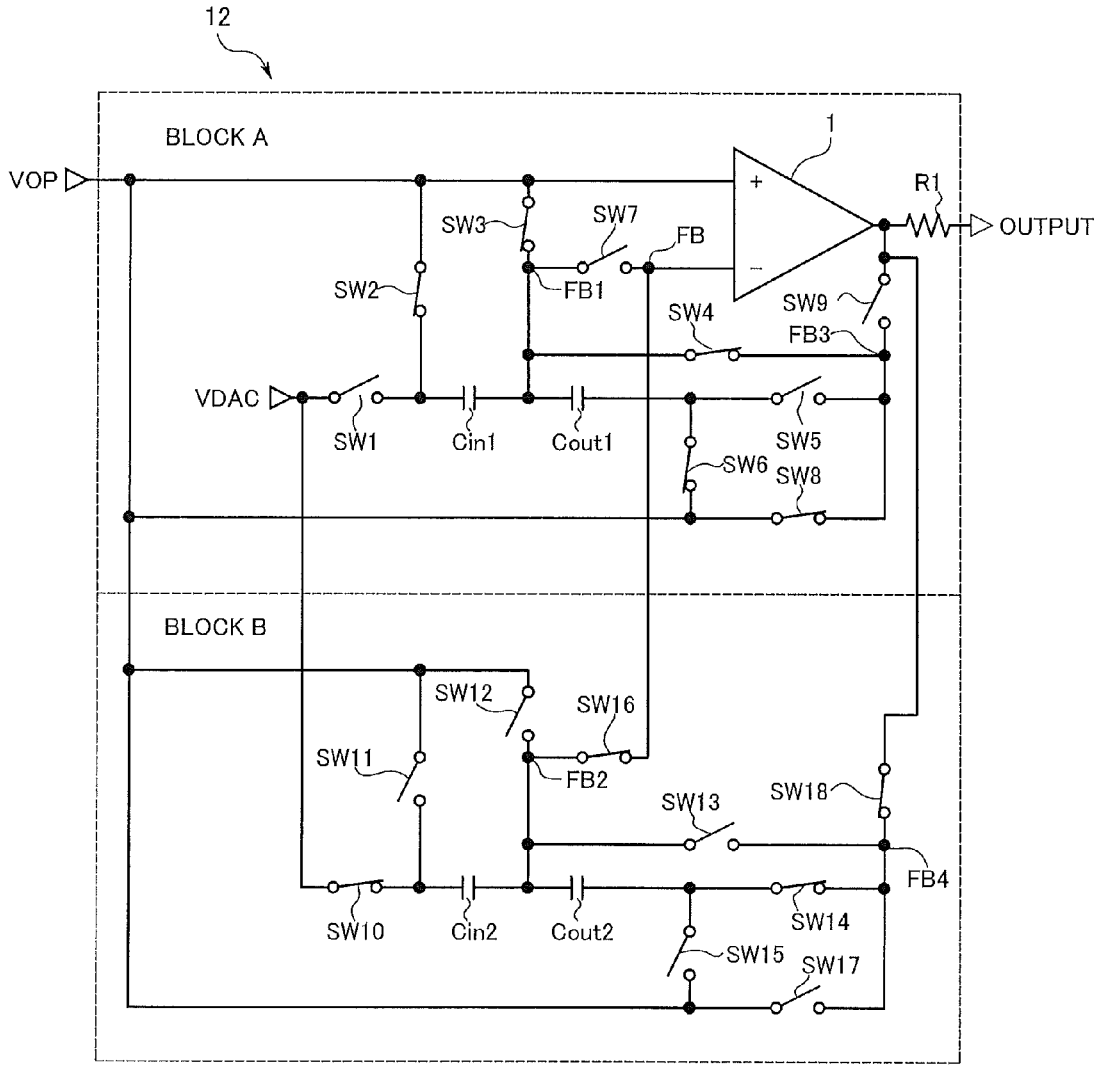
FIG. 12 is a circuit diagram showing on/off states of the switch devices when the other block is in the reset condition and said one block is in the normal output mode in the output circuit of FIG. 9.

When the block A is in the reset mode and the block B is in the normal output mode, then the switch devices SW1, SW5, SW7, and SW9 are turned off and the switch devices SW2 to SW4, SW6, and SW8 are turned on in the block A as shown in FIG. 12. In the block B, the switch devices SW10, SW14, SW16, and SW18 are turned on, and the switch devices SW11 to SW13, SW15, and SW17 are turned off.

For example, at the beginning of each frame, the block A enters the reset mode in response to the external reset signal and then shifts to the normal output operation in response to the initial writing signal. The block B performs the reset operation in response to the initial writing signal. Thereafter, the blocks A and B perform the reset operation and the normal output operation as shown in FIG. 10.

In the reset operation of the block A, the switch devices SW2 to SW4, SW6, and SW8 are turned on so that both terminals of the input capacitor Cin1 are shorted and both terminals of the output capacitor Cout1 are shorted while the reference voltage VOP is being applied. As such, the reference voltage VOP is applied to both terminals of each of the input and output capacitors Cin1 and Cout1. The voltage of the node FB1 becomes equal to the reference voltage VOP. In addition, in the reset operation of the block A, the node FB1 is electrically disconnected from the inverting input terminal of the output amplifier 1 due to the turning off of the switch device SW7, and the output terminal OUT of the output amplifier 1 is independent from other circuit parts (except for the resistor R1) of the block A due to the turning off of the switch device SW9.

When the block A enters the normal output operation from the reset condition, the node FB1 becomes in a floating state, and the output amplifier 1 is operated such that the voltage of the node FB1 is held to the reference voltage VOP. In other words, charges flow in the input capacitor Cin1 corresponding to the differential voltage between the reference voltage VOP and the voltage VDAC, and charges flow in the output capacitor Cout1 corresponding to the differential voltage between the output voltage of the output amplifier 1 and the reference voltage VOP, thereby generating the output voltage.

When the block A performs the normal output operation, the block B is in the reset condition. When the block B is in the reset condition, the switch devices SW11 to SW13, SW15, and SW17 are turned on, so that both terminals of the input capacitor Cin2 are shorted and both terminals of the output capacitor Cout2 are shorted while the reference voltage VOP is being applied. Thus the reference voltage VOP is applied to both terminals of each of the input and output capacitors Cin2 and Cou2. The voltage of the node FB2 becomes equal to the reference voltage VOP. When the block B is in the reset condition, the node FB2 is electrically disconnected from the inverting input terminal of the output amplifier 1 due to the turning off of the switch SW16. In addition, the output terminal OUT of the output amplifier 1 becomes independent from other circuit parts of the block B due to the turning off of the switch S18.

When the block B shifts to the normal output operation from the reset condition, the node FB2 also shifts to a floating state, and the output amplifier 1 is operated such that the voltage of the connection point FB2 is kept to the reference voltage VOP. In other words, charges flow in the input capacitor Cin2 corresponding to the differential voltage between the reference voltage VOP and the voltage VDAC, and charges flow in the output capacitor Cout2 corresponding to the differential voltage between the output voltage of the output amplifier 1 and the reference voltage VOP, thereby generating the output voltage.

When the block B performs the normal output operation, the block A is in the reset condition as described above.

In the block A, since the reference voltage VOP is applied to the node FB3 between the switch device SW4 and the switch device SW9 through the switch device SW8, the voltage of the connection point FB3 is held to the reference voltage VOP. Therefore, the voltage between both terminals of the switch device SW4, that is, the voltage between the source and the drain of the switch device SW4, is equal to the reference voltage VOP, and the leakage current between the source and drain of the switch device SW4 is reduced (eliminated). Also the current leaking from the output terminal OUT of the output amplifier 1 to the node FB through the channel between the source and drain of the switch device SW4 is reduced.

Similarly, in the block B, since the reference voltage VOP is applied to the node FB4 between the switch device SW13 and the switch device SW18 through the switch device SW17, the voltage of the connection point FB4 is held to the reference voltage VOP. Therefore, the voltage between both terminals of the switch device SW13, that is, the voltage between the source and the drain, is equal to the reference voltage VOP, and the leakage current leaking between the source and drain of the switch device SW13 can be reduced. Also the current leaking from the output terminal OUT of the output amplifier 1 to the node FB through the channel between the source and drain of the switch device SW13 can be reduced.

Since the blocks A and B alternately repeat the normal output operation and the reset operation at the timings in synchronization with the horizontal synchronization signals in such a manner that an operation of the block A differs from an operation of the block B, the reference voltage which is changed due to the leakage current can return to an original reference voltage in every one horizontal period. Accordingly, the same quantity as a leaking current to the basis parts from the switch devices (FETs) can be supplemented (compensated), and the influence of the offset voltage of the output amplifier can be more effectively minimized.

It should be noted that the present invention is not limited to the illustrated embodiments. For example, although the block A includes the output amplifier 1 in the offset reduction output circuit 12 shown in FIG. 9, the output amplifier 1 may be provided in the block B, or provided outside the block A (or B). In addition, the switch device may not be limited to the P-channel FET, but may be an N-channel FET.

This application is based on Japanese Patent Application No. 2011-78010 filed on Mar. 31, 2011, and the entire disclosure thereof is incorporated herein by reference.

What is claimed is:

1. An offset reduction output circuit for a source driver adapted to receive a gray scale voltage corresponding to gray scales represented by digital data and to generate a driving voltage to be supplied to a liquid display panel, the offset reduction output circuit comprising:

an operational amplifier having a non-inverting input terminal, an inverting input terminal and an output terminal, said non-inverting input terminal being adapted to receive a reference voltage;

a first input capacitor having one terminal and opposite terminal;

a first output capacitor having one terminal and opposite terminal, said one terminal of the first input capacitor and said one terminal of the first output capacitor being coupled to a first node connected to the inverting input terminal of the operational amplifier in at least a normal output operation; and a first switching circuit for shorting said one terminal of the first input capacitor to said opposite terminal of the first input capacitor and for shorting said one terminal of the first output capacitor to said opposite terminal of the first output capacitor in a reset operation so that the reference voltage is applied to said one and opposite terminals of the first input capacitor and to said one and opposite terminals of the first output capacitor, and for applying the gray scale voltage to said opposite terminal of the first input capacitor and for connecting an opposite terminal of the first output capacitor to the output terminal of the operational amplifier in the normal output operation after the reset operation, wherein the first switching circuit includes a first switch device and a second switch device connected with each other in series at a connection point, the first and second switch devices are connected between the first node and the output terminal of the operational amplifier, turned on in the reset operation, and turned off in the normal output operation, and wherein the reference voltage is applied to the connection point of the first and second switch devices in the normal output operation.

2. The offset reduction output circuit of claim 1, wherein the first switching circuit further includes a third switch device connected between the connection point of the first and second switch devices and an application terminal of the reference voltage, and wherein the third switch device is turned off in the reset operation, and turned on in the normal output operation, so that the reference voltage is applied to the connection point of the first and second switch devices.

3. The offset reduction output circuit of claim 1, wherein at least the first input capacitor, the first output capacitor, and the first switching circuit constitute a first block, wherein the offset reduction output circuit further comprises:

a second input capacitor having one terminal and an opposite terminal and a second output capacitor having one terminal and an opposite terminal, said one terminal of the second input capacitor and said one terminal of the second output capacitor being connected to a second node connected to the inverting input terminal of the operational amplifier in at least the normal output operation; and a second switching circuit for shorting said one terminal of the second input capacitor to said opposite terminal of the second input capacitor and for shorting said one terminal of the second output capacitor to said opposite terminal of the second output capacitor in the reset operation so that the reference voltage is applied to the one and opposite terminals of the second input capacitor and to the one and opposite terminals of the second output capacitor, and for applying the gray scale voltage to the one terminal of the second input capacitor and for connecting the opposite terminal of the second output capacitor to the output terminal of the operational amplifier in the normal output operation after the reset operation, and wherein at least the second input capacitor, the second output capacitor and the second switching circuit constitute a second block, the first block alternately performs the reset operation and the normal output operation and the second block alternately performs the normal output operation and the reset operation in synchronization with a horizontal synchronization signal in such a manner that the first block performs the reset operation when the second block performs the normal output operation whereas the first block performs the normal output operation when the second block performs the reset operation.

4. The offset reduction output circuit of claim 3, wherein the second switching circuit includes fourth and fifth switch devices, the fourth switch device and the fifth switch device being coupled to each other in series at a second connection point, connected between the second node and the output terminal of the operational amplifier, turned on in the reset operation, and turned off in the normal output operation, and the second switching circuit applies the reference voltage to the second connection point of the fourth and fifth switch device via a sixth switch device in the normal output operation.

5. The offset reduction output circuit of claim 1, wherein the operational amplifier is a capacitor-coupled operational amplifier.

6. An offset reduction output circuit for a source driver adapted to receive a gray scale voltage corresponding to gray scales represented by digital data and to generate a driving voltage to be supplied to a liquid display panel, the offset reduction output circuit comprising:

a first block including an operational amplifier, a first input capacitor, a first output capacitor and a first switching circuit such that the first block alternately performs a reset operation and a normal output operation in synchronization with a horizontal synchronization signal; and a second block including a second input capacitor, a second output capacitor, and a second switching circuit such that the second block alternately performs the normal output operation and the reset operation in synchronization with said horizontal synchronization signal and such that the second block performs the reset operation when the first block performs the normal output operation whereas the second block performs the normal output operation when the first block performs the reset operation, wherein said operational amplifier has a non-inverting input terminal, an inverting terminal and an output terminal, said non-inverting input terminal being adapted to receive a reference voltage, said first input capacitor has one terminal and opposite terminal, said first output capacitor has one terminal and opposite terminal, said one terminal of the first input capacitor and said one terminal of the first output capacitor being coupled to a first node connected to the inverting input terminal of the operational amplifier in at least the normal output operation, said first switching circuit is adapted to short said one terminal of the first input capacitor to said opposite terminal of the first input capacitor and to short said one terminal of the first output capacitor to said opposite terminal of the first output capacitor in a reset operation so that the reference voltage is applied to said one and opposite terminals of the first input capacitor and to said one and opposite terminals of the first output capacitor, said first switching circuit is further adapted to apply the gray scale voltage to said opposite terminal of the first input capacitor and to connect an opposite terminal of the first output capacitor to the output terminal of the operational amplifier in the normal output operation after the reset operation, the first switching circuit includes a first switch device and a second switch device connected with each other in series at a connection point, the first and second switch devices are connected between the first node and the output terminal of the operational amplifier, turned on in the reset operation, and turned off in the normal output operation, and the reference voltage is applied to the connection point of the first and second switch devices in the normal output operation.

said second input capacitor has one terminal and an opposite terminal, said second output capacitor has one terminal and an opposite terminal, said one terminal of the second input capacitor and said one terminal of the second output capacitor being connected to a second node connected to the inverting input terminal of the operational amplifier in at least the normal output operation; and said second switching circuit is adapted to short said one terminal of the second input capacitor to said opposite terminal of the second input capacitor and to short said one terminal of the second output capacitor to said opposite terminal of the second output capacitor in the reset operation so that the reference voltage is applied to the one and opposite terminals of the second input capacitor and to the one and opposite terminals of the second output capacitor, said second switching circuit is further adapted to apply the gray scale voltage to the one terminal of the second input capacitor and to connect the opposite terminal of the second output capacitor to the output terminal of the operational amplifier in the normal output operation after the reset operation.

7. The offset reduction output circuit of claim 6, wherein the first switching circuit further includes a third switch device connected between the connection point of the first and second switch devices and an application terminal of the reference voltage, and wherein the third switch device is turned off in the reset operation, and turned on in the normal output operation, so that the reference voltage is applied to the connection point of the first and second switch devices.

8. The offset reduction output circuit of claim 6, wherein the second switching circuit includes fourth and fifth switch devices, the fourth switch device and the fifth switch device being coupled to each other in series at a second connection point, connected between the second node and the output terminal of the operational amplifier, turned on in the reset operation, and turned off in the normal output operation, and the second switching circuit applies the reference voltage to the second connection point of the fourth and fifth switch device via a sixth switch device in the normal output operation.

9. The offset reduction output circuit of claim 6, wherein the operational amplifier is a capacitor-coupled operational amplifier.

* * * * *